United States Patent [19]

Barker, III

[11] 4,133,975

[45] Jan. 9, 1979

[54] LOUDSPEAKER SYSTEM WITH BROAD IMAGE SOURCE WITH DIRECTIONALITY CONTROL FOR THE TWEETER

[75] Inventor: Charles R. Barker, III, Harvard, Mass.

[73] Assignee: Bose Corporation, Framingham, Mass.

[21] Appl. No.: 762,017

[22] Filed: Jan. 24, 1977

Related U.S. Application Data

[63] Continuation of Ser. No. 564,543, Apr. 2, 1975, abandoned.

[51] Int. Cl.[2] ..... H04R 1/20; H04R 1/28

[52] U.S. Cl. ..... 179/1 E; 179/1 GA; 181/144; 181/155; 181/156

[58] Field of Search ..... 179/1 D, 1 E, 1 GA; 181/143, 144, 145, 146, 147, 148, 149, 150, 151, 152, 153, 154, 155, 156, 175, 176, 199

[56] References Cited

U.S. PATENT DOCUMENTS

| | | | |
|---|---|---|---|
| 2,073,747 | 3/1937 | Koroncai et al. | 181/148 |
| 2,109,431 | 2/1938 | McDonald | 181/154 |
| 2,193,398 | 3/1940 | Fisher | 181/154 |
| 3,153,120 | 10/1964 | Brown | 179/1 G |
| 3,727,004 | 4/1973 | Bose | 179/1 D |
| 3,759,345 | 9/1973 | Borisenko | 179/1 GA |

FOREIGN PATENT DOCUMENTS

| | | | |
|---|---|---|---|
| 1065467 | 9/1959 | Fed. Rep. of Germany | 179/1 GA |
| 973570 | 3/1960 | Fed. Rep. of Germany | 179/1 G |
| 1160894 | 1/1964 | Fed. Rep. of Germany | 179/1 GA |
| 1537609 | 1/1970 | Fed. Rep. of Germany | 181/176 |
| 623860 | 8/1961 | Italy | 179/1 E |

*Primary Examiner*—George G. Stellar
*Attorney, Agent, or Firm*—Charles Hieken

[57] ABSTRACT

A loudspeaker system comprises a woofer in a front panel, a midrange driver facing to the front and a tweeter in a corner panel separated from the midrange driver by the woofer and pointing to the front and side with a crossover network arranged to energize at least the midrange and tweeter in an overlapping frequency range. An adjustable deflector is positioned near the tweeter. Another embodiment of the invention has only a woofer and a tweeter on only one corner panel with the crossover network arranged to energize the two in a common frequency range that is greater than an octave.

15 Claims, 8 Drawing Figures

LOUDSPEAKER SYSTEM WITH BROAD IMAGE SOURCE WITH DIRECTIONALITY CONTROL FOR THE TWEETER

This is a continuation of application Ser. No. 564,543, filed Apr. 2, 1975, now abandoned.

BACKGROUND OF THE INVENTION

The present invention relates in general to loudspeaker systems and more particularly concerns novel apparatus and techniques for providing an inexpensive bookshelf loudspeaker with few placement constraints that is relatively inexpensive to manufacture while offering unique spatial properties.

The internationally known BOSE 901 loudspeaker system embodies principles for simulating in the home sound of the character heard in the concert hall. For optimum results the BOSE 901 loudspeaker is located about a foot from a wall facing angled speaker panels to provide a good balance of reflected and direct sound with a substantially uniform radiated power response in cooperation with an electronic active equalization network. While performance of this system is excellent, there are a number of home listening locations where placement for optimum performance is difficult.

Accordingly, it is an important object of this invention to provide a bookshelf loudspeaker having few placement constraints offering unique spatial properties while being relatively inexpensive to manufacture.

It is another object of the invention to achieve the preceding objects with a relatively compact system.

It is still a further object of the invention to achieve one or more of the preceding objects while providing a good balance of direct and reflected sound and presenting a broad acoustical image source that is interesting to the listener.

SUMMARY OF THE INVENTION

According to the invention, there is a loudspeaker cabinet having a first panel for supporting a first driver means, and at least a second panel for supporting second driver means that faces to the front and side, first driver means mounted on the first panel for radiating acoustical energy in a first frequency range, second driver means supported on the second panel for radiating energy in a second frequency range that includes portions higher than the first frequency range and a common frequency range that overlaps the first frequency range for at least a half octave and crossover network means for coupling electrical energy from an input terminal pair to the first driver means and the second driver means so that the first driver means radiates energy over said first frequency range and the second driver means radiates energy over said second frequency range.

According to another aspect of the invention there is adjustable deflector means intercepting the energy radiated by the second driver means for directing the high frequency energy radiated therefrom in a predetermined direction. According to a specific aspect of the invention there is at least a third panel for supporting third driver means between the first and second panels, and third driver means supported on the third panel.

Numerous other features, objects and advantages of the invention will become apparent from the following specification when read in connection with the accompanying drawing in which:

DETAILED DESCRIPTION OF PREFERRED EMBODIMENTS

Figure 1:
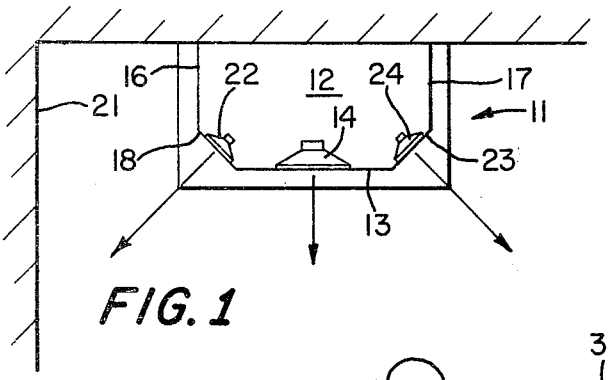
FIG. 1 is a top view of an embodiment of the invention in a room.
Figure 2:
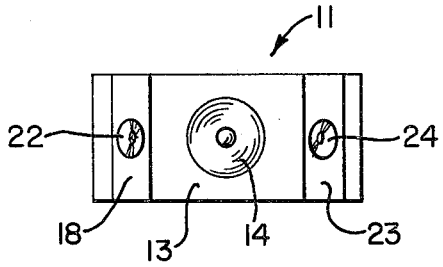
FIG. 2 is a front view of the embodiment of FIG. 1.

With reference now to the drawing and more particularly FIG. 1 thereof, there is shown a top view of a loudspeaker system according to the invention for reproducing only one channel of an input sound signal in a room. The loudspeaker cabinet 11 includes a top 12, a front panel 13 supporting a woofer 14, side panels 16 and 17, a corner panel 18 facing the side wall 21 and carrying a tweeter 22 and a corner panel 23 facing toward the center of the room and carrying a midrange driver 24. FIG. 2 is a front view of loudspeaker system 11. The listener 25 receives some direct sound from midrange driver 24 and reflected sound from tweeter 22.

In this embodiment low frequency woofer 14 typically radiates between 40 Hz and a first crossover frequency by itself and between the first crossover frequency and a second crossover frequency with midrange driver 24. Midrange driver 24 radiates between the first crossover frequency and a third crossover frequency. Tweeter 22 radiates between the second crossover frequency and 18 kHz. drivers 22 and 24 have an overlapping range between 3 kHz and 7 kHz. The first crossover frequency is typically within the range of 500 to 1000 Hz; the second, between 2 kHz and 3 kHz; and the third between 6 kHz and 9 kHz. A loudspeaker thus arranged produces a very wide diffused acoustical spatial image, especially noticeable in stereo with both tweeters 22 facing the adjacent sidewall. By arranging loudspeaker system 11 as shown, the embodiment in FIG. 2 may be flipped over so that the top 12 is on the bottom and thereby tweeter 22 will be to the right of woofer 14 as seen by listener 25.

The invention is believed to produce this widely diffused spatial image by taking advantage of some known factors. It is known that humans receive much auditory localization information from the high frequency components of sound having spectral components above 1 kHz. The invention takes advantage of this characteristic in a number of ways. The very high frequency components radiate toward the sidewall away from the listener, and the reflections from the side wall create a virtual image of the tweeter on the other side of the wall spaced from the sidewall by the same distance between the sidewall and the tweeter 22. To create a reasonably well localized virtual image, tweeter 22 is reasonably directional as distinguished from the omnidirectional tweeters usually used in conventional loudspeaker systems. A small amount of high frequency components are radiated directly at the listener 25 by the midrange driver 24. It was discovered that failing to provide this direct high frequency component would cause an instrument to tend to sound far away and smeared whereas providing this direct component maintained a proper crispness to instruments.

It is known in psycoacoustics (Gardner, Journal of the Acoustical Society of America, Vol. 46, No. 2 1969) that several things can be done to effect the fusion of a sonic image. By having two sources that are physically separated and radiate overlapping portions of the spectrum, it is possible to produce the impression of a single broad source located between them. It s also known that by taking two separated loudspeakers and arranging to radiate signals from them in phase opposition while adjusting the amplitude of one of the loudspeakers, it is possible to create phantom sources that lie outside of the region between the two sources.

Figure 6:
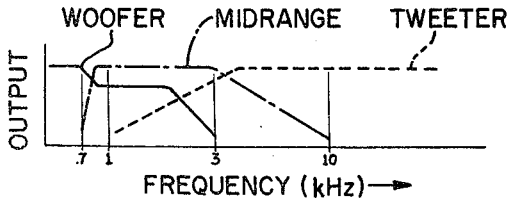
FIG. 6 illustrates the frequency ranges of the woofer, midrange driver and tweeter in the embodiment of FIGS. 1 and 2.

The invention takes advantage of these characteristics by having the crossover between the two drivers 22 and 24 of gentle slope as shown in FIG. 6 with considerable overlap in the crossover region where both drivers radiate spectral components in this common region. By proper selection of the midrange driver 24 and the tweeter 22, it is possible to achieve two 180° phase shifts at relatively narrow bands of frequencies in the common frequency range where drivers 22 and 24 radiate in phase opposition in the regions about the fundamental resonances of the drivers. Drivers 22 and 24 each typically have a fundamental resonance in the common frequency range, that of tweeter 22 being higher than that of midrange driver 24 to effect these phase shifts. Although these phase shifts may produce a desirable effect, there is presently insufficient evidence to positively confirm it.

By having spatially separate sound sources radiating, the apparent location of the sound source moves from one side to the other with spectrum of the radiated signal. Since music generally contains a broadband signal, the apparent source is constantly apparently in motion to the listener, and the listener is unable to localize the sound as coming from any one point but perceives the sound as coming from a broad source. The combination of these effects produces a loudspeaker with a wide spatial image.

Figure 3:
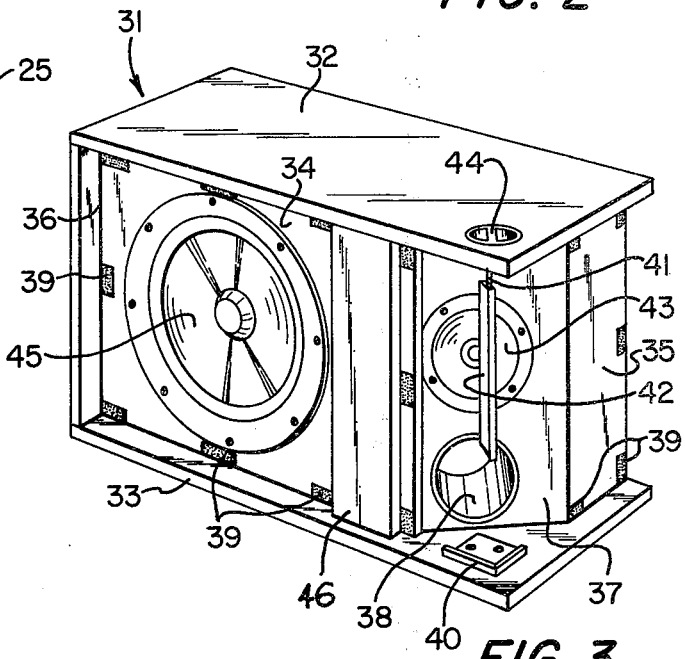
FIG. 3 is a perspective view of an embodiment of the invention using only two drivers for each loudspeaker cabinet.

Referring to FIG. 3, there is shown a perspective view of another embodiment of the invention that uses only two drivers while being relatively easy to locate, having superior spatial properties relative to a conventional loudspeaker and being adjustable to the taste of the listener for room and source characteristics. FIG. 3 shows a right-cornered loudspeaker system 31 for reproducing only one channel of an input sound signal, such as the left channel of a stereo sound signal, having rectangular top and bottom panels 32 and 33, a rectangular front panel 34 side panels 35 and 36, a rear rectangular panel (not visible in FIG. 3) and an angled corner panel 37 formed with a port 38. Woofer 45 is mounted in front panel 34. A vertical shaft 41 split at the bottom depends from the corner of top panel 32 and carries a sound deflecting panel or vane 42 facing tweeter 43 mounted in corner panel 37. A knob 44 attached to vertical shaft 41 controls the orientation of sound panel 42 for adjustment to control the energy radiated directly to the listener. Deflecting panel 42 pivots about an axis near its front edge so that movement of the rear edge toward and from the woofer deflects less and more energy, respectively, toward the center of the room.

Velcro tabs, such as 39, are attached to the front and side panels for mating engagement with Velcro tabs on grill cloth assemblies (not shown). One nearly square grill cloth assembly covers woofer 45. A two-panel hinged assembly bears against corner plate 40 and covers the tweeter corner and side. A finished vertical wooden slat 46 separates the two assemblies.

Figure 4:
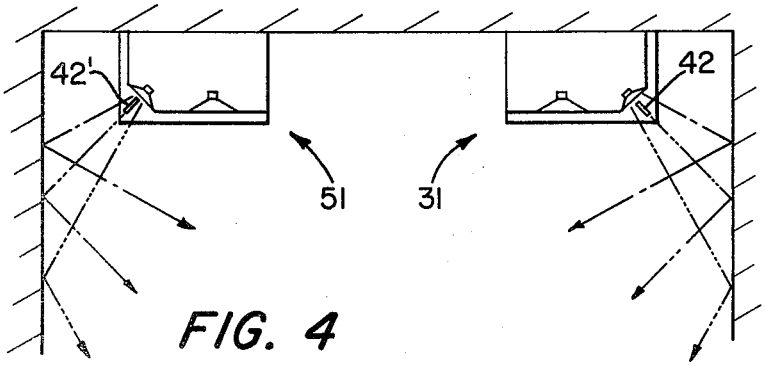
FIG. 4 is a plan view of a pair of loudspeakers according to the invention in a room arranged for stereo.

Referring to FIG. 4, there is shown a plan view of right loudspeaker system 31 for reproducing only the right channel and a left loudspeaker system 51 for reproducing only the left channel that is the mirror image of right loudspeaker system 31. A feature of the invention is that each woofer typically operates over the frequency range from 30 Hz to 3.0 kHz while each tweeter typically operates over a range of 1.2 to 18 kHz so that the overlapping or common frequency range is of the order of 1.8 kHz and preferably an octave or more but no less than a half octave. It was discovered that a common frequency range as low as ⅓ octave resulted in sounds from the same instrument appearing to come from different locations while a common frequency range preferably at least an octave avoided the problem. A common frequency range of a half octave may be acceptable but a greater range is preferred.

Another feature of the invention is that tweeter 43 is highly directional, unlike conventional loudspeaker systems which feature omnidirectional tweeters. The directional tweeter facilitates exercising good control over where the energy from the tweeter is directed with the deflecting panel 42. FIG. 4 shows the normal position of deflecting panels 42 and 42' with the plane of each along the tweeter axis. In this position the listener perceives a reasonably wide image extending somewhat into the center region between the loudspeaker systems when used in stereo. By moving the rear edges of deflecting panels 42 and 42' further away from the woofer, more high frequency energy is deflected toward the center of the room to enhance the center image. The image perceived is then less spatious than in the normal position and sounds more intimate. This position may be advantageous when listening to a vocalist or single instrument.

By moving the rear edges of deflecting panels 42 and 42' toward the woofer, more high frequency energy is directed away from the listener and back toward the rear and sidewalls to create a very spacious sound image with less center image between the loudspeaker systems. This position may be useful when the loudspeaker systems are positioned very close to each other, such as in a small room.

It is preferred that the deflecting panels 42 and 42' be arranged so that as a deflecting panel is rotated, it is possible to redirect as much energy from the tweeter as possible, it should function at as low a frequency as practical, it should not hornload the tweeter and rotation of the deflecting panels should not change the radiated power frequency response of the loudspeaker system, this response being substantially constant. The deflecting panel should be massive and stiff enough so that it reflects at the frequencies of interest and its length, and width preferably are larger than a wavelength at these frequencies. These frequencies are typically above 3 kHz, typically the second crossover frequency. The rear edge preferably is very close to tweeter 43.

Figure 5:
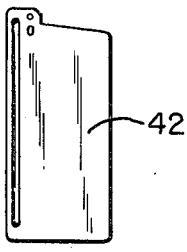
FIG. 5 is a plan view of a preferred form of a deflector panel according to the invention.

Referring to FIG. 5, there is shown a plan view of a preferred form of deflecting panel which meets these criteria made of 0.025" thick black anodized or chromated high strength aluminum. It may be advantageous to place sound absorbing material on the side of the deflecting panel that faces the tweeter when the rear edge of the deflecting panel is pointed away from the woofer because there is then less high frequency absorption compared with other positions when there is substantial reflection from the walls allowing coverings and other objects to absorb.

Figure 7:
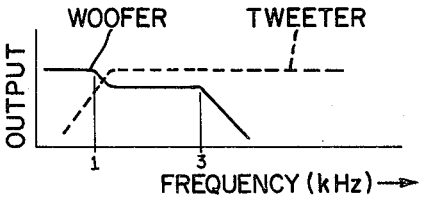
FIG. 7 illustrates the frequency ranges of the woofer and tweeter in the embodiment of FIG. 3.

Referring to FIGS. 6 and 7, there are shown graphical representations of typical crossover network responses with the system according to the invention in the embodiments of FIGS. 1 and 3 respectively. The crossover networks comprise means for intercoupling the input terminal and the loudspeaker driver means for providing spectral components in a common frequency range to first and second ones of the loudspeaker driver means, the means for intercoupling including means for attenuating spectral components applied to the first and second frequencies respectively at the high and low ends respectively of the common frequency range relative to spectral components applied thereto in the common frequency range. For the embodiment of FIG. 3 this common frequency range is between 1 and 3 kHz with the first driver being woofer 45 and the second driver being tweeter 43 and the first and second frequencies being substantially 3 and 1 kHz, respectively. For the embodiment of FIGS. 1 and 2, there is a common frequency range and first and second frequencies between the woofer and midrange driver, between the midrange driver and the tweeter and between the woofer and tweeter as seen in FIG. 6. The crossover network thus comprises means for establishing the crossover between the first and second drivers of gentle slope in the common frequency range so that the difference between the first driver output frequency response and second driver output frequency response is substantially the same over the common frequency range.

Figure 8:
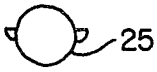
FIG. 8 is a schematic circuit diagram of a loudspeaker system for the embodiment of FIG. 3.
Figure 8:
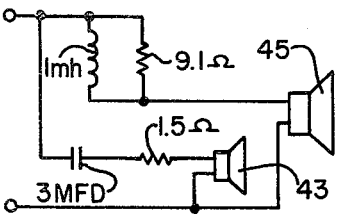

Referring to FIG. 8 there is shown a schematic circuit diagram of a preferred crossover network for use with the loudspeaker system of FIG. 3 in which woofer 45 is an 8" woofer having a d-c impedance of 5.7 ohms, tweeter 43 is a three inch electrodynamic speaker having a d-c resistance of 6.5 ohms to form a system that has a nominal 8 ohm impedance and radiates a substantially uniform power response as a function of frequency. This network coacts with the tweeter to produce an on-axis free-field pressure response that rises as a function of increasing frequency so that the system has a substantially uniform radiated power response as a function of frequency.

It is within the principles of the invention to mount one or more tweeters on gimbals to permit energy to be directed upward or downward and to enable a loudspeaker system to be oriented with its length horizontally or vertically while still permitting energy to be reflected from sidewalls. While a ported structure is shown and preferred for efficiency reasons, it is within the principles of the invention to use a sealed cabinet.

Although the invention preferably uses reflections from sidewalls when available, a system according to the invention may function as a spatially extended source without using wall reflections. The invention achieves this effect by having at least two spaced drivers, such as a woofer and a tweeter, that operate over a common frequency range, and exhibit different transfer characteristics between the input terminal pair of the loudspeaker and the room into which the system radiates. A preferred way of achieving these differences is to use transducers having different characteristics, such as a woofer and a tweeter. The woofer such as 45 may be regarded as a first loudspeaker driver supported by the cabinet for radiating sound energy to the front over a first frequency range and having a first polar response, and the tweeter such as 43 may be regarded as a second loudspeaker driver supported by the cabinet for radiating sound energy to the front and side over a second frequency range mostly higher than the first frequency range and having a second directional polar response different from the first polar response.

If two spaced drivers with identical characteristics radiate the same sound, the ear perceives the sound as originating midway between the two. The brain is believed to act as a cross correlator that correlates the signal perceived by the left ear with the signal perceived by the right ear, producing an effective cross correlation signal characterized by spikes because of the coherence between the signals emitted by the like drivers. By causing the drivers to have dissimilar characteristics over a substantial common frequency range, there is no coherence between the signals emitted by the drivers with the result that there is no spike in the effective cross correlation response of the left and right ears. The sound perceived is then more nearly like that perceived by a listener in the concert hall because there is an absence of exact coherence between the sounds provided by the spaced instruments.

An actual commercial embodiment of the invention is the BOSE Model 301 loudspeaker system. The panels are typically made of ½" thick particle board with a density of 42–46 pounds. The top and bottom panels are typically 17" by 9 ¼". The front panel is typically 12" by 10", and the side panel facing the center of the room is typically 9 ¼" by 10". The angle between front panel 34 and corner panel 37 is substantially 135 degrees, and the diameter of port 38 is substantially 2 ½". Deflecting panel 42 is substantially 2 ¼" wide, 4 31/32" long along the front edge and substantially 15/32" less along the rear edge with its axis of rotation substantially 5/32" from the front edge.

An embodiment of the invention corresponding substantially to the embodiment of FIG. 1 includes a 10" woofer having a d-c resistance of 6 ohms having a depressed shelf response beginning at 700 Hz and tapering down to 3 kHz, a midrange driver or middler having a d-c resistance of 6.5 ohms having a response that begins at about 700 Hz to complement the woofer to about 3 kHz tapering down from 3 kHz to 10 kHz and a tweeter having a d-c resistance of 6.5 ohms that complements the woofer and middler from 1.2 kHz to 3 or 4 kHz and then extends to about 16 kHz. The woofer and middler thus overlap for more than two octaves, the middler and tweeter overlap for more than three octaves and the tweeter and woofer overlap for more than an octave. A suitable crossover network for coaction with these drivers comprises connecting the woofer directly across the input terminals, connecting the series combination of a 13 ohm resistor, 5 mfd. capacitor and the driver across the input terminals and a 2 mfd. capacitor in series with the tweeter across the input terminals. Respective adjustable deflecting panels similar to panel 42 in FIG. 3 are adjacent to the middler and tweeter.

There has been described novel apparatus and techniques for reproducing sound with high quality perceived as emanating from a relatively broad source and that performs well in a wide variety of listening environments. Yet the structure is compact and relatively easy and inexpensive to fabricate. It is evident that those skilled in the art may now make numerous uses and modifications of and departures from the specific embodiments described herein without departing from the inventive concepts. Consequently, the invention is to be construed as embracing each and every novel feature and novel combination of features present in or possessed by the apparatus and techniques herein disclosed and limited solely by the spirit and scope of the appended claims.

What is claimed is:

1. A loudspeaker system comprising, means defining an enclosure having top, bottom, rear and at least one side panel, a front baffle for supporting woofer means for radiating low audio frequency signals and an angled baffle adjacent to said front baffle and to tweeter means for directionally radiating high audio frequency signals, said woofer means supported on said front baffle, said tweeter means supported adjacent to said angled baffle and characterized by a directional radiation pattern having a maximum direction of radiation oriented along an axis directed both forward and sideward of said front baffle, knob means supported by said top panel in the region above said tweeter means, and means including said knob means for selectively positioning said maximum of radiation between a front end position with said direction of radiation more forward than sidewards and a side end position with said direction of radiation more sideward than forward.

2. A loudspeaker system in accordance with claim 1 wherein said loudspeaker system has its rear panel adjacent to a first wall of a room with said tweeter means being positioned for radiating high audio frequency signals toward a second wall intersecting and generally perpendicular to said first wall for reflection first from said second wall and then into the listening area of said room with said woofer means facing said listening area.

3. A loudspeaker system in accordance with claim 1 wherein said means for selectively positioning is restricted to angular displacement about an axis generally perpendicular to said top and bottom panels.

4. A loudspeaker system in accordance with claim 3 wherein said means for selectively positioning comprises means angularly displaceable by said knob means about the axis of said knob means.

5. A loudspeaker system in accordance with claim 4 wherein said means angularly displaceable is a deflecting vane.

6. A loudspeaker system in accordance with claim 5 wherein said deflecting vane has a movable free edge adjacent to said tweeter means and a front edge embracing the knob means axis.

7. A loudspeaker system in accordance with claim 1 and further comprising a second of said loudspeaker systems that is substantially the mirror image of the first of said loudspeaker systems.

8. A loudspeaker system in accordance with claim 7 wherein said first and second loudspeaker systems are spaced along a first wall adjacent to said rear panels with said tweeter means being positioned for radiating high audio frequency signals toward another wall generally perpendicular to said first wall for reflection first from a said another wall and then into the listening area of a room comprising said walls and said woofer means facing said listening area.

9. A loudspeaker system in accordance with claim 8 wherein the tweeter means of said first and second loudspeaker systems are positioned for radiating high audio frequency signals toward first and second another walls respectively that are separated by said first wall.

10. A loudspeaker system in accordance with claim 1 wherein said top and bottom panels are substantially rectangular, there are first and second side panels, said first side panel being between and generally perpendicular to said top, bottom and rear panels and said front baffle, said second side panel being generally perpendicular to said top, bottom and rear panels and said front baffle and between said top and bottom panels and said angled baffle with a perpendicular to said angled baffle corresponding to a selectable maximum of radiation direction.

11. A loudspeaker system in accordance with claim 10 wherein said means for selectively positioning is restricted to angular displacement about an axis generally perpendicular to said top and bottom panels.

12. A loudspeaker system in accordance with claim 11 wherein said means for selectively positioning comprises means angularly displaceable by said knob means about the axis of said knob means.

13. A loudspeaker system in accordance with claim 12 wherein said means angularly displaceable is a deflecting vane.

14. A loudspeaker system in accordance with claim 13 wherein said deflecting vane has a movable free edge adjacent to said tweeter means and a front edge embracing the knob means axis.

15. A loudspeaker system comprising, cabinet means for supporting loudspeaker drivers, first loudspeaker driver means supported by said cabinet for radiating sound energy to the front, second loudspeaker driver means supported by said cabinet for radiating sound energy to the front and side, an input terminal pair, means for intercoupling said input terminal and said first and second loudspeaker driver means for providing spectral components in a common frequency range to said first and second loudspeaker driver means, said means for intercoupling coacting with said first and second loudspeaker driver means to comprise means for dissimilarly radiating from first and second locations defined by said first and second loudspeaker driver means respectively spectral components over said common frequency range to provide a spatially diffuse source, said common frequency range being at least half an octave, said first loudspeaker driver means being supported in a front panel of said cabinet with its axis substantially perpendicular to said front panel and second loudspeaker driver means being supported with its axis making an acute angle with the axis of said first loudspeaker driver means, said second loudspeaker driver means having a directional radiation characteristic directed predominantly within a solid angle centered about its axis, a movable sound deflecting panel adjacent to said second loudspeaker driving means for controllably deflecting energy therefrom, means for supporting said movable sound deflecting panel for rotation about an axis adjacent to its front edge with its rear edge closer to said second loudspeaker driver means than said front edge, said sound deflecting panel being made of substantially rigid material that reflects sound above a predetermined frequency in the frequency range radiated by said second loudspeaker driver means and having first and second spans in orthogonal directions each greatr than a wavelength at and above said last-mentioned frequency, wherein said cabinet includes a top panel and further comprising, rotatable knob means supported in said top panel above said sound deflecting panel for rotating the latter, and means for attaching the top of said sound deflecting panel to said rotatable knob means so that movement of the latter rotates said sound deflecting panel about said axis near its front edge.

* * * * *